United States Patent [19]

Scholl et al.

[11] Patent Number: 4,869,185

[45] Date of Patent: Sep. 26, 1989

[54] FOLDING DEVICE FOR AN AUTOMATIC SEWING MACHINE

[75] Inventors: Hans Scholl, Oerlinghausen-Lipperreihe; Wolfram Schulze, Bielefeld, both of Fed. Rep. of Germany

[73] Assignee: Kochs Adler Aktiengesellschaft, Fed. Rep. of Germany

[21] Appl. No.: 273,230

[22] Filed: Nov. 18, 1988

Related U.S. Application Data

[63] Continuation of Ser. No. 168,263, Mar. 15, 1988, Pat. No. 4,819,572.

[51] Int. Cl.[4] ..... D05B 35/00; D05B 3/12

[52] U.S. Cl. ..... 112/147; 112/141; 112/121.15; 112/104; 112/114

[58] Field of Search ..... 112/147, 141, 136, 121.15, 112/121.12, 104, 113, 114, 306, 121.29

[56] References Cited

U.S. PATENT DOCUMENTS

| | | | |
|---|---|---|---|
| 3,143,091 | 8/1964 | Arbter | 112/121.15 X |
| 3,351,032 | 11/1967 | Junkins | 112/121.15 |
| 3,528,378 | 9/1970 | Westhoff et al. | 112/121.15 |
| 3,769,924 | 11/1973 | Rogers et al. | 112/121.12 X |
| 3,842,766 | 10/1974 | Connor, Jr. | 112/121.12 |
| 3,878,801 | 4/1975 | Conner, Jr. | 112/121.29 |
| 3,970,016 | 7/1976 | Yanikoski | 112/104 X |
| 4,069,778 | 1/1978 | Kozawa | 112/121.12 |
| 4,088,085 | 5/1978 | Hager | 112/121.15 X |
| 4,282,819 | 8/1981 | Sartor | 112/121.12 |

*Primary Examiner*—H. Hampton Hunter

*Attorney, Agent, or Firm*—Laff, Whitesel, Conte & Saret

[57] ABSTRACT

A folding device for an automatic sewing machine has a carrier plate for a first workpiece, a sword which is movable in the longitudinal direction thereof to receive a second workpiece and an outer frame having creasing devices for folding the second workpiece around the sword. The outer frame is pivotable into a total of three different working positions. In addition, it is movable out of its working positions into a retracted position. The purpose of this measure is to improve the field of vision for the operator while at the same time reducing the risk of an accident.

10 Claims, 8 Drawing Sheets x
y
Lmax
20
32
37
38
39
40
41
41'
42
42'
44
44'
45
45'
46
47
48
48'
49
49'
50
50'
51
51'
52
53
55
55'
55a
55a'
56
56'
57
57a
57b
57c
58
59
60
61
62
64
65
66
67
69
70
72
84a
84b
84c
109
12
2
18
19
22
24
36
II
III

FOLDING DEVICE FOR AN AUTOMATIC SEWING MACHINE

This application is a continuation of application Ser. No. 168,263 filed Mar. 15, 1988 now U.S. Pat. No. 4,819,572 dated Apr. 11, 1989.

FIELD OF THE INVENTION

The invention relates to a folding device for an automatic sewing machine having a carrier plate for a first workpiece, a sword attached to a sword carrier for receiving a second workpiece and an outer frame attached to an outer frame carrier and having creasing devices for folding the second workpiece around the sword, the sword being movable by movement of its sword carrier between a lower working position on the carrier plate and an upper working position above the carrier plate, and the outer frame being movable by movement of its carrier into a lower working position on the carrier plate, a central working position corresponding to the upper working position of the sword and, above this central working position, an upper work starting position, and it being possible for the sword to be drawn out of its working position into a retracted position out of the second workpiece.

BACKGROUND OF THE INVENTION

The catalogue of the Necchi company "IMB 1985" discloses an automatic sewing machine with a folding device having the designation NECCHI UAN 2531/A, which machine has an outer frame which is rigidly mounted on an outer frame carrier and can be pivoted upwardly by great angles or distances in order that the operator may handle the workpieces under this outer frame. Despite these great pivoting angles or distances the field of vision of the operator is limited. In addition, there is the danger that an operator keeping his head over the folding device may be struck on the head by the outer frame when the latter is pivoted upwardly.

SUMMARY OF THE INVENTION

It is an object of the invention to provide a folding device of the type as defined above in such a manner that the field of vision is improved and at the same time the risk of an accident is reduced.

According to the invention the outer frame can be moved out of its working positions into a retracted position in the outer frame carrier. The basic idea of the invention is to effect upward pivoting of the outer frame only to such a degree that the second workpiece situated on the sword is released from the lower workpiece situated on the carrier plate and that the outer frame can travel over the sword. The improvement in vision is created by making it possible for the outer frame to be moved back into the outer frame carrier, i.e. moved completely out of the field of vision of the operator during manipulation of the workpieces by the operator on the carrier plate or on the sword.

When the outer frame carrier has a slidable carriage which bears the outer frame, and when the carriage is slidable on guides in the outer frame carrier, and when an outer frame displacing drive is provided in the outer frame carrier, the movability of the outer frame relative to the outer frame carrier is achieved by particularly simple measures.

When the outer frame carrier and the sword carrier are mounted pivotably about a common tilt axle, and when the guides of the outer frame are inclined relative to the outer frame in such a manner that, when the sword and outer frame are in the working position on the carrier plate, the sword carrier and the outer frame carrier have a smaller spacing on a side remote from the tilt axle and a side facing the outer frame or the sword than on a side facing the tilt axle, and when with the sword and outer frame in the working position on the carrier plate, the sword carrier engages between the guides of the outer frame carrier, and when the angle of inclination between the outer frame and the guides is approximately 10° to 25°, the outer frame carrier can accomodate the sword carrier mainly between its guides for the outer frame, and also the outer frame carrier always remains in a very low position above the carrier plate, i.e. does not geenerally impair the field of vision.

When a free space which is open in a direction parallel to the tilt axle and extends as far as below the carrier plate is formed between the carrier plate and the tilt axle, also large workpieces, which still have a great length above the second workpiece to be sewn on, are laid flat on the area of support and can then be suspended in the free space between the tilt axle and carrier plate. It is therefore no longer necessary to roll or fold these large workpieces into this area, thereby also simplifying subsequent conveyance by means of a feeding device from the folding device to a sewing head. In addition, this development makes it possible to automate the loading of the folding device because a transfer arm or the like of a loading device can engage not only on the operator's side, but also in the free space.

DESCRIPTION OF THE PREFERRED EMBODIMENTS

Figure 1:
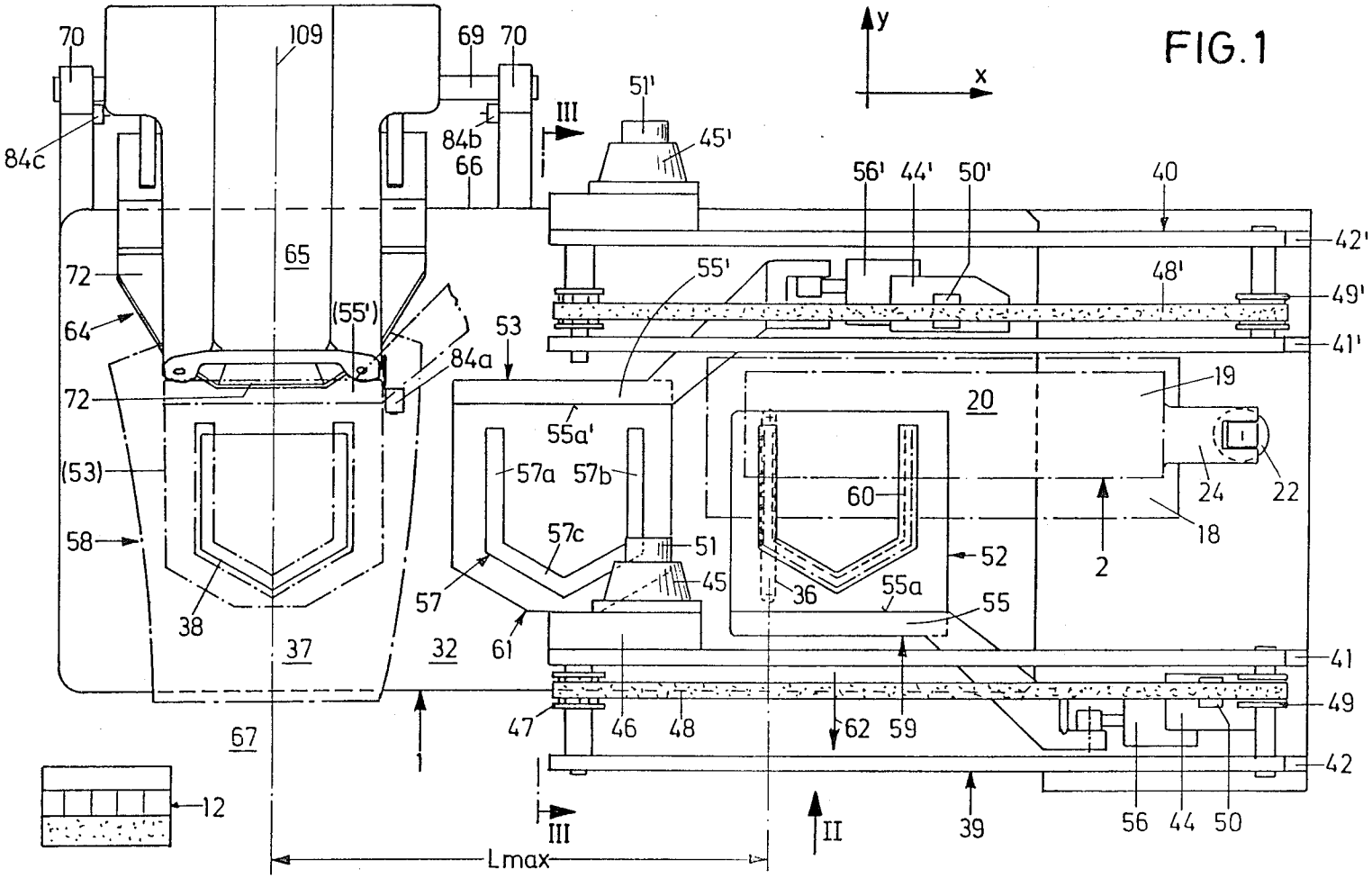
FIG. 1 shows a plan view of an automatic sewing machine according to the invention.

Design of the Automatic Sewing Machine with a Feeding Device

The automatic sewing machine shown in FIGS. 1 to 4 has a stand 1 on which a sewing head 2 is arranged. The sewing head 2 is arranged so as to be movable in a y-direction on a carriage 3—shown in more detail in FIGS. 3 and 4. The direction defined as an x-direction is that which runs in a horizontal plane in the longitudinal direction of the sewing head 2. The direction defined as the y-direction is that which runs perpendicular thereto, also in a horizontal plane or substantially horizontal plane. The sweing head carriage is slidable on two guide bars 4, 5 which are supported on the upper side 7 of the stand 1 by means of corresponding mounts 6. To drive the sewing head carriage 3 on the guide bars 4 parallel to one another there is provided a carriage drive 8 having an electric motor 9 with a gear 10 and a pulse generator 11 which is connected in the usual manner to the shaft (not shown) of the motor 9 and transmits pulses dependent on the angle of rotation. For example, with every 1° rotation of the motor shaft the pulse generator 11 transmits a pulse which is fed to a central computerized control 12 from where the motor 9, in turn, is controlled. Driven by the motor 9 via the gear 10 is a toothed timing belt pulley 13 which, in turn, drives an endless toothed timing belt 14 which is guided via a deflection pulley 15. The toothed timing belt pulley 13 and the deflection pulley 15 are mounted on the stand 1 in corresponding bearings 16. The toothed timing belt 14 runs parallel to the guide bars 4, 5. The upper part of the belt 14 is attached to the underside of the sewing head carriage 3 by a fastening device 17.

Figure 5:
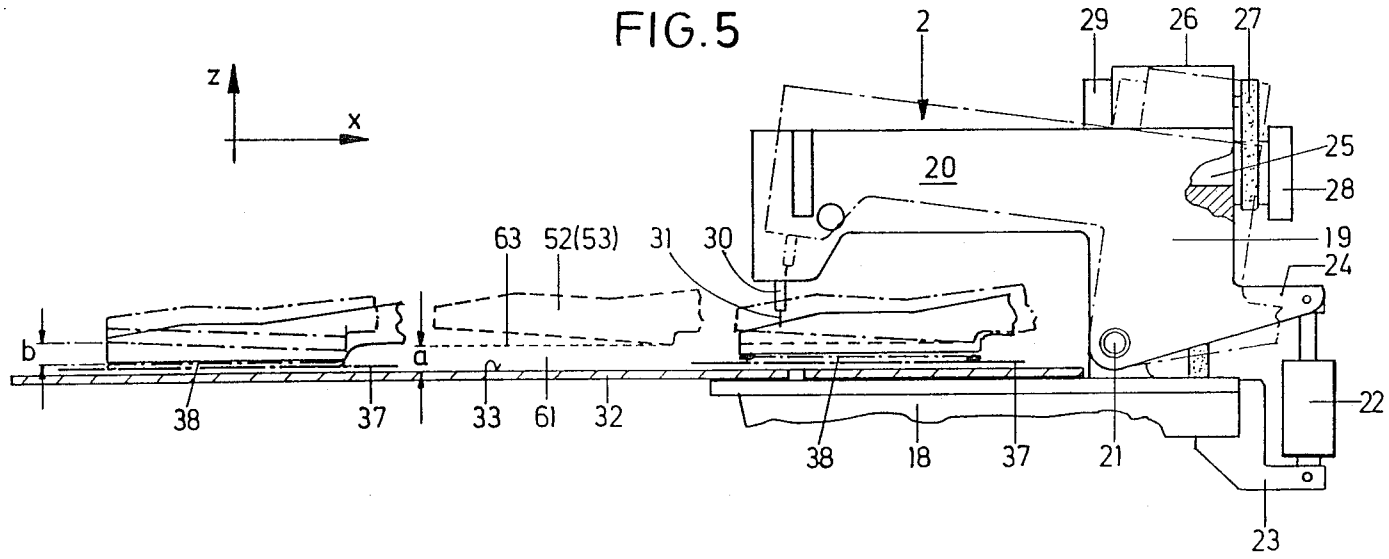
FIG. 5 shows, in a partial front view, a movement sequence of the feeding devices of the automatic sewing machine.

The sewing head 2 consists in the usual manner of a base plate 18, a stand 19 and an upper arm 20. As shown in FIGS. 1 and 5, the stand 19 is pivotable with the arm 20 about a tilt axle 21 which is horizontal and extends in the y-direction. For this purpose a tilt drive 22 comprising a pneumatically actuatable piston cylinder unit is connected, on one side, to a bearing arm 23 connected to the base plate 18 and, on the other side, to an operating arm 24 connected to the stand 19. Upon corresponding actuation of this tilt drive 22 the stand 19 is pivoted upwardly with the arm 20 of the sewing head 2 out of the working position, shown by unbroken lines in FIG. 5, into the position indicated by dot-dash lines.

An arm shaft 25, which can be driven by an electric sewing head drive motor 26 via a toothed timing belt drive 27, is mounted in the usual manner in the arm 20 of the sewing head 2. A hand wheel 28 is mounted on the outer end of the arm shaft 25, which hand wheel 28 is rotatable by the arm shaft 25, but non-rotatable with respect to the arm shaft 25. In addition, a pulse generator 29 is attached to the motor 26 and—in like manner to the pulse generator 11—transmits a pulse to the computerized control 12 with every rotation angle unit of, for example, 1°. The drive of a needle bar 30 and needle 31 and also the drive of the stitch forming tools situated in the base plate 18 are derived from the arm shaft 25 in the usual manner. The direction of movement of the needle bar 30 and needle 31 is defined as the z-direction which is perpendicular to the plane covered by the x-direction and y-direction.

Above the upper side 7 of the stand 1 there is arranged on this stand a carrier plate 32 in the x-y-plane, i.e. in the horizontal plane, the upper side of which defines a sewing plane 33. This carrier plate 32 is supported—outside the range of movement of the base plate 18 in the y-direction—on a supporting plate 34 which is supported on the stand 1 by posts 35. Within the range of movement of the base plate 18 of the sewing head 2 this carrier plate 32 is supported on the upper side of the base plate 18. Over the distance in the y-direction by which the sewing head 2 can be moved with the needle 31, the base plate 18 has a slot 36 which, in every position of movement of the sewing head 2 relative to the stand 1, permits passage of the needle 31 to the stitch forming tools on the base plate 18.

Above the carrier plate 32 there are provided two devices for feeding workpieces 37, 38 which are to be sewn together. A first feeding device 39 is arranged on one side—shown at the bottom of FIG. 1—of the sewing head 2 on the stand 1, whereas the second feeding device 40 is arranged on the stand 1 on the other side—shown at the top of FIG. 1—of the sewing head 2. The two feeding devices 39, 40 are in principle designed and arranged in mirror symmetry with one another so that in each case the corresponding part of the first feeding device 39 is designated by a reference numeral and the corresponding part of the second feeding device 40 is designated by the same reference numeral with a prime mark.

Each of the two feeding devices have two vertical carrying walls 41, 41' and 42, 42', respectively, running parallel to one another in the x-direction. Attached to the inner carrying walls 41 and 41' adjacent to the sewing head 2 are guide bars 43 and 43', respectively, which extend parallel to one another in the x-direction and on which carriages 44 and 44', respectively, are arranged so as to be slidable in the x-direction. This carriage is driven by an electric motor 45 or 45' having a secondary gear 46 or 46', a toothed timing belt pulley 47 or 47' and an endless toothed timing belt 48 or 48'. The toothed timing belts 48 and 48' are guided via deflection pulleys 49 and 49', respectively. The timing belt pulleys 47 and 47' and the deflection pulleys 49 and 49' are mounted between the two carrying walls 41, 42 and 41' and 42', respectively. Each carriage 44 or 44' is attached to each lower part of the corresponding timing belt 48 or 48' by means of a fastening device 50, 50'. Each motor 45 or 45' is associated with a pulse generator 51 or 51' which is constructed and operates in the same way as the puls generators 11 or 29 already descrived above.

A first workpiece holder 52 and a second workpiece holder 53 are attached to the carriages 44 and 44', respectively. These workpiece holders 52 and 53 are attached to respective carriages 44 and 44' about tilt axles 54 and 54', respectively, extending in the y-direction. For this purpose they are attached to the end of an angle lever 55 or 55' which is pivotable about the corresponding tilt axle 54 or 54' and on the other end of which a lifting and pressing drive 56 or 56' engages. These drives 56 and 56' are pneumatically actuatable piston-cylinder drives which are mounted on respective carriages 44 and 44'.

The two workpiece holders 52, 53 have slots 57 and 57', respectively, which follow the path of a seam to be sewn. The two workpieces 37, 38 concerned are, for example, a trouser piece (first workpiece 37) and a pocket piece (second workpiece 38). These workpieces are arranged in a transfer position 58 on the carrier plate 32. The manner in which they are brought into this position will be described further on in the text. The second workpiece 38, which is formed for example by a pocket piece, lies folded and positioned on the first workpiece 37. This position of the two workpieces 37, 38 in the transfer position 58 corresponds to the outermost position of the two workpiece holders 52, 53, as indicated by dot-dash lines in FIG. 1 for the second workpiece holder 53.

Mode of Operation of the Automatic Sewing Machine with Feeding Device

The second workpiece holder 53 of the second feeding device 40 is in an upwardly pivoted position, i.e. it is brought into an upwardly pivoted position by means of the lifting and pressing drive 56'. The first workpiece holder 52 of the first feeding device 39, already in the transfer position 58, is lowered on to the workpieces 37, 38 and compresses them, and presses them on to the carrier plate 32 which is particularly smooth. The lower sides of the workpiece holders 52, 53, i.e. the sides of the workpiece holders 52, 53 which are adjacent to the workpieces 37 and 38, respectively, have in the usual manner friction linings which ensure that the two workpieces 37, 38 do not slip towards one another nor slip together in relation to the workpiece holder 52 or 53. As a result of appropriate triggering of the motor 45 by the computerized control 12, the carriage 44 is now moved with the workpiece holder 52 and workpieces 37, 38 via the carrier plate 32 in the x-direction, which therefore defines the feeding direction, from the transfer position 58 into a sewing position 59 at the sewing head 2, i.e. below the needle bar 30. The sewing of a seam 60, which follows the path of the slot 57, takes place while the sewing head 2 is moved in the y-direction and the first workpiece holder 52 in the x-direction. The first feeding device 39 is therefore used firstly for feeding the workpieces 37, 38 from the transfer position 58 into the sewing position 59 and, at the same time, for guiding these workpieces 37, 38 during the sewing operation. During this sewing operation the second workpiece holder 53 is moved in a lifted position by way of workpieces 37, 38 which have already been repositioned in the transfer position 58, as indicated by dot-dash lines in FIG. 2. By appropriate actuation of the drive 56' the workpiece holder 53 is lowered on to the workpieces 37, 38, pressing them against one another and against the carrier plate 32. Then the motor 45' is triggered by the computerized control 12 in such a manner that the carriage 44' is moved into a central position in which the workpiece holder 53 is situated in a waiting position 61—which can only be seen in FIG. 1. The space in the area of the transfer position 58 is already free again so that new workpieces 37, 38 can again be prepared and positioned.

When the sewing operation with the workpieces 37, 38 situated in the sewing position 59 below the first workpiece holder 52 is terminated, this first workpiece holder 52 is lifted by appropriate actuation of the drive 56 so that the sewn together workpieces 37, 38 can be removed from the automatic sewing machine in the unloading direction 62 corresponding to the reverse y-direction. Immediately following this operation, the second workpiece holder 53 which is in the waiting position 61 can be moved with the new workpieces 37, 38 into the sewing position 59. A new sewing cycle can commence in the same way. The first workpiece holder 52 which is situated above the second workpiece holder 53 is now moved when in this lifted position over the second workpiece holder 53 up to and over the transfer position 58. The transfer of the workpieces 37, 38 and movement into the waiting position 61 proceed as already described. All the triggering operations of all the motors 9, 26, 45, 45' are performed by the computerized control 12. This working sequence is shown in FIG. 5, that is, only by way of example applying to the first workpiece holder 52 which, when in the lowered position is shown by unbroken lines in the sewing position 59. When in the lifted position above the sewing position 59, it is represented by dot-dash lines. When passing through the waiting position 61 it is represented by broken lines in the raised position. When in the raised position above the transfer position 58, it is represented again by dot-dash lines. When in the lowered position in which it transfers the workpieces 37, 38, it is again shown by unbroken lines. The movement of the workpiece holders 52, 53 from the transfer position 58 into the sewing position 59 via the waiting position 61 takes place therefore in the region of the sewing plane 33. The reverse movement takes place in a plane of reverse motion 63 lying above the sewing plane 33. The perpendicular distance a between these planes 33 and 63 is in any case somewhat greater than the thickness b of the workpiece holders 52, 53. In order that this distance a or the thickness b may be minimized, the angle levers 55, 55' on the corresponding workpiece holders 52 or 53 engage only on faces **55*a* and 55*a'* of respective workpiece holders 52, 53 lying parallel to the x-direction. These two faces 55*a* and 55*a'* lie opposite one another, as can be seen from FIG. 1. The distance between the faces is such that the angle lever 55 of the workpiece holder 52 does not come into contact with the workpiece holder 53 if the two workpiece holders 52, 53** are moved over one another. Accordingly, the reverse applies.

In order that the workpiece holder 52 or 53 may be lifted out of the sewing plane 33 into the plane of reverse motion 63, the needle 31 must be moved out of the range of the workpiece holder 52, 53. For this purpose the upper arm 20 of the sewing head 2 is pivoted upwardly into the position indicated by dot-dash lines in FIG. 5 by appropriate actuation of the tilt drive 22. This tilt drive is likewise triggered by the computerized control 12. In order that the sewing operation may be freely observed, the feeding devices 39, 40 are arranged at a sufficiently high level above the carrier plate 32.

Design of the Folding Device

Arranged ahead of the transfer position 58 of the workpieces is a folding device 64 in which the second workpiece 38 is folded and guided together with the first workpiece 37 in a correct position. This folding device 64 has a cover-like carrier 65 which is arranged above the carrier plate 32, and projects partly above the latter towards the rear side 66 of the stand 1, the rear side 66 being understood as the side opposite the operator's front side 67. At its end on the rear side the carrier 65 has a downwardly projecting lever arm 68. In the area of its transition into the lever arm 68, the carrier is mounted so as to be pivotable about a tilt axle 69 which extends in the x-direction and which is retained in two bearing arms 70 which are attached to the rear side 66 of the stand 1 and project upwardly therefrom in the direction of the rear side 66. Engaging on the lower end of the lever arm 68 is an outer frame tilt drive 71 which is a pneumatically actuatable three-position piston-cylinder-drive which, apart from being positioned in two end positions, can therefore also be positioned in an intermediate position whereby the carrier 65 and thus the outer frame 72 supported by this carrier 65 can be set in three different tilt positions. The tilt drive 71 is supported relative to the rear side 66 of the stand 1, as will be described further on in the text.

In the carrier 65 there are arranged two guide bars 73 which extend perpendicular to the x-direction and are parallel to one another and on each of which the outer frame 72 is slidably guided by means of a slide bearing 74. When the carrier 65 is in the upwardly and back pivoted position shown in FIG. 6, the guide bars 73 extend approximately parallel to the carrier plate 32 in the y-direction. Above and between the guide bars 73 there is provided in the carrier 65 an outer frame displacing drive 75 which engages on the slide bearings 74. This displacing drive 75 is therefore a linear drive which in this case can be, for example, a pneumatic cylinder without a piston rod, which is marketable under the name ORIGA. With the aid of this displacing drive 75 can be brought into a position which can be seen in FIG. 6 and is fully extended out of the carrier 65 in the direction of the operator's side 67, and into a position which is shown in FIG. 7 and largely retracted into the carrier 65.

Figure 2:
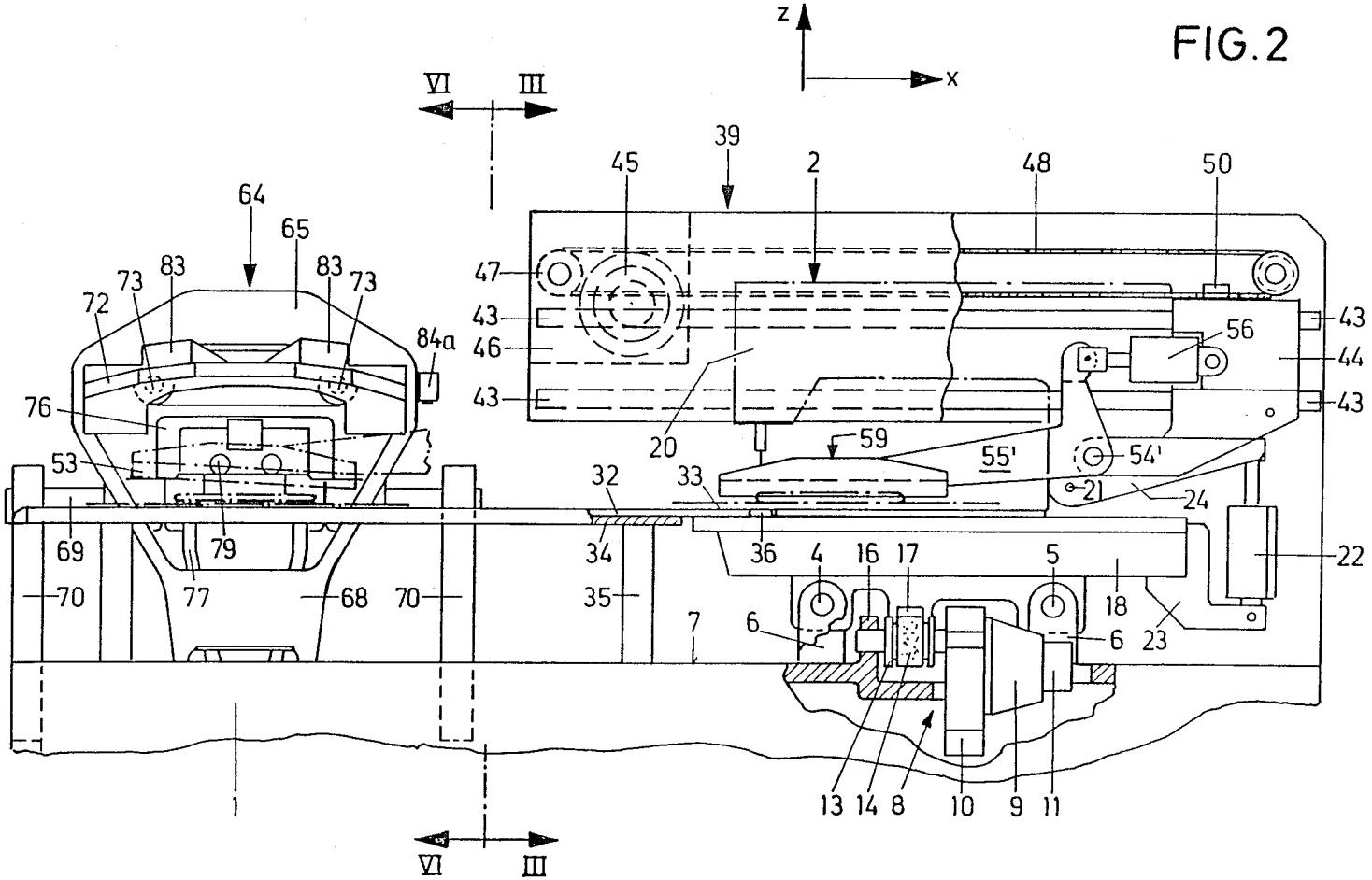
FIG. 2 shows a front view, partially broken away, of the automatic sewing machine according to the arrow II in FIG. 1.
Figure 3:
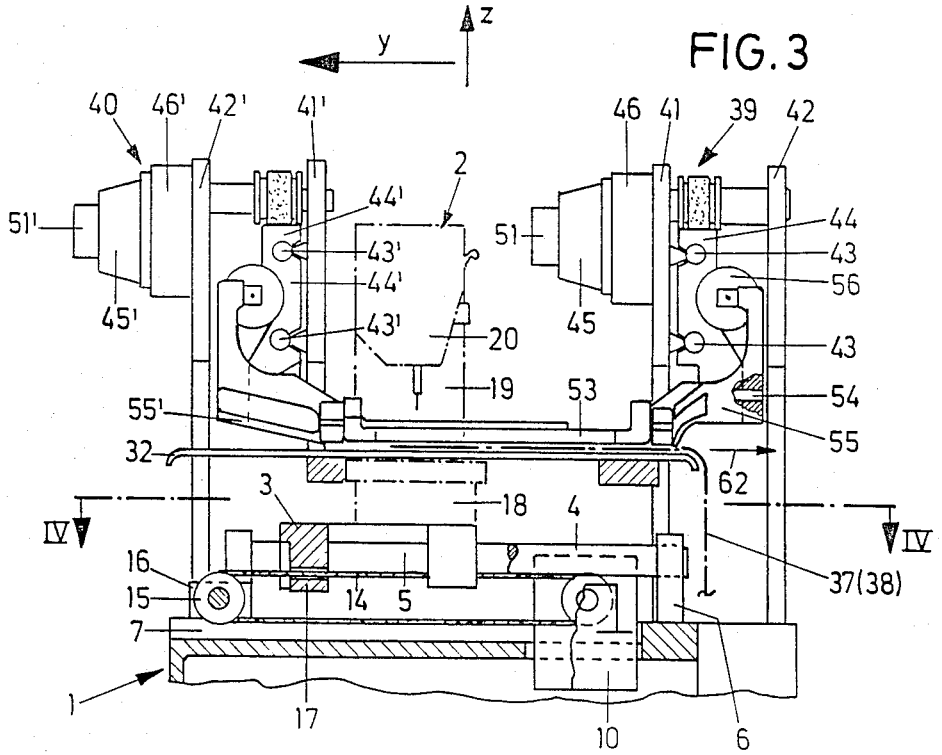
FIG. 3 shows a vertical partial section through the automatic sewing machine along the line III—III in FIG. 2.
Figure 4:
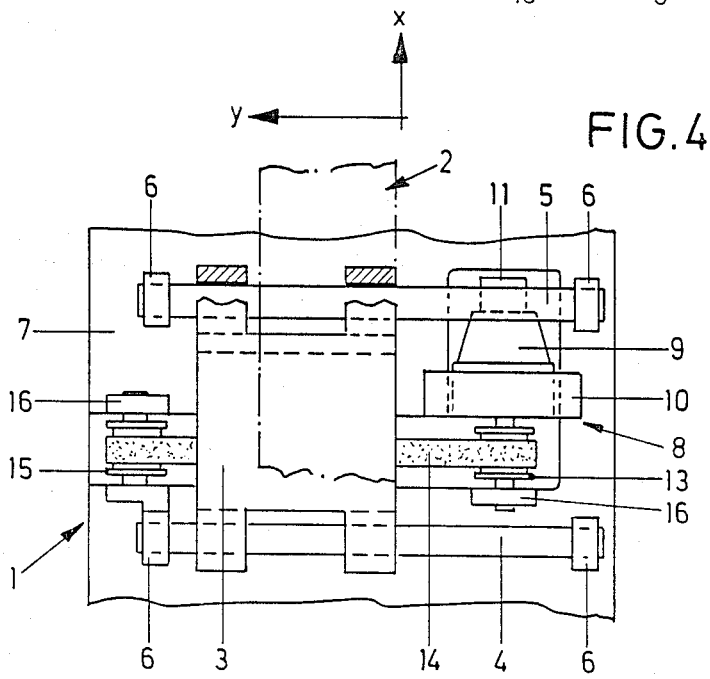
FIG. 4 shows a vertical partial section through the automatic sewing machine along the line IV—IV in FIG. 3.
Figure 8:
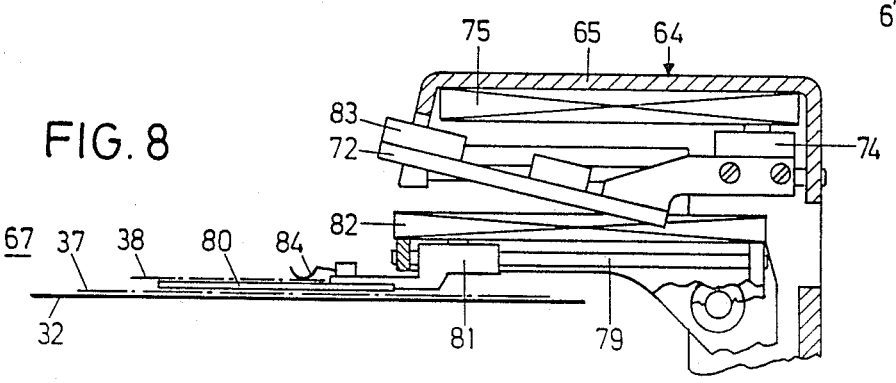
FIG. 8 shows a partial view, in vertical longitudinal section, of the folding device in a working position.

Also mounted pivotably on the tilt axle 69 is a sword carrier 76 which is arranged essentially below the outer frame carrier 65 and in particular below the guide bars 73 and slide bearings 74. At the end of this sword carrier 76 and on its rear side, there is formed a downwardly extending arm 77 which is arranged essentially inside the lever arm 68. A sword tilt drive 78 by means of which the sword carrier 76 is pivotable about the tilt axle 69, engages on the lower end of this arm 77. In the sword carrier 76 there are arranged—as can be seen in FIGS. 8 and 2—two guide bars 79 which are parallel to one another and extend essentially in the y-direction and on which a so-called sword 80 is slidably mounted by means of slide bearings 81. The sword is displaced by way of a sword discplacing drive which is arranged in the sword carrier and which can be designed identically to the outer frame displacing drive 75. Displacement occurs between two end positions.

The sword 80 has in the usual manner a contour corresponding to the shape of the workpiece 38 to be folded. In this case its shape corresponds therefore to the pocket which is shown on the left side of FIG. 1 and which is to be sewn as the second workpiece 38 on to the first workpiece 37. In addition, the sword 80 has a very thin design and is made, for example, of spring steel.

The outer frame 72 arranged above the sword 80 is adapted to the outer controur of the sword 80. In the area in which the second workpiece 38, for example therefore a pocket piece, is to be folded around the outer edges of the sword 80, the outer frame carries on its outer circumference so-called creasing modules 83 which in this case are standard pneumatically actuatable units by means of which the material is to be folded around the edge of the sword. Swords 80 of this type and outer frames 72 with creasing modules 83 are commonly used in the automization of sewing operations.

Figure 10:
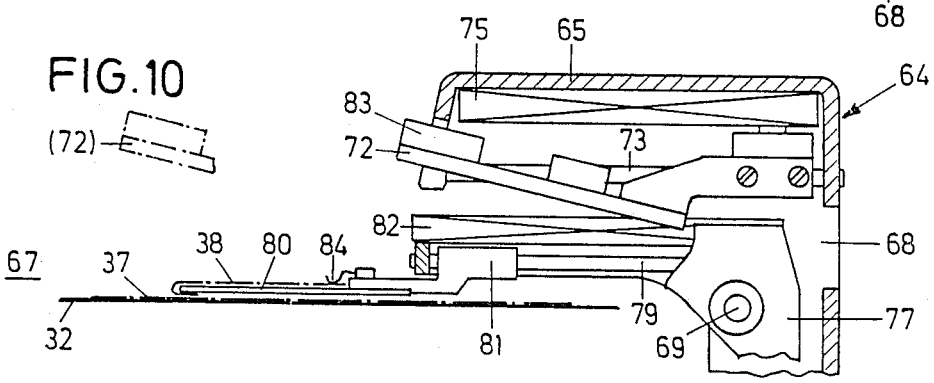
FIG. 10 shows the folding device according to FIG. 8, in another working position.

As is evident for example from FIGS. 8 and 10, the sword 80 is in its lowered position, i.e. lying flat on the first workpiece 37 or parallel to the carrier plate 32 when the sword tilt drive 78 is extended. The sword 80 is pivoted upwardly out of this position about the tilt axle 69 by upward pivoting of the sword carrier 76 about an angle r of, for example, 5°.

The outer frame 72 of the folding device 64 is pivoted out of its lower position, resting on the carrier plate 32, into its upper position (see FIG. 7) about an anngle s which is approximately 10° to 20° and is preferably approximately 15°, as shown in the drawing. The angle s is as small as possible. It is made only sufficiently large to enable the outer frame 72 to be moved over the sword 80 without an operator being able to jam his hands between these parts. When in the mentioned intermediate position the outer frame 72 is situated on the sword 80 in its upper position (see FIG. 9). As is also evident from FIGS. 8 to 10, the sword 80 is arranged parallel to its guide bars 79 whilst the outer frame 72 is angled upwardly relative to its guide bars 73 by an angle of inclination t which is approximately equal to the angle s, i.e. 10° to 20° and preferably 15°. It follows that the guide bars 79 extend approximately parallel to the carrier plate 32 when the outer frame 72 is in its upper position.

Mode of Operation of the Folding Device

Figure 9:
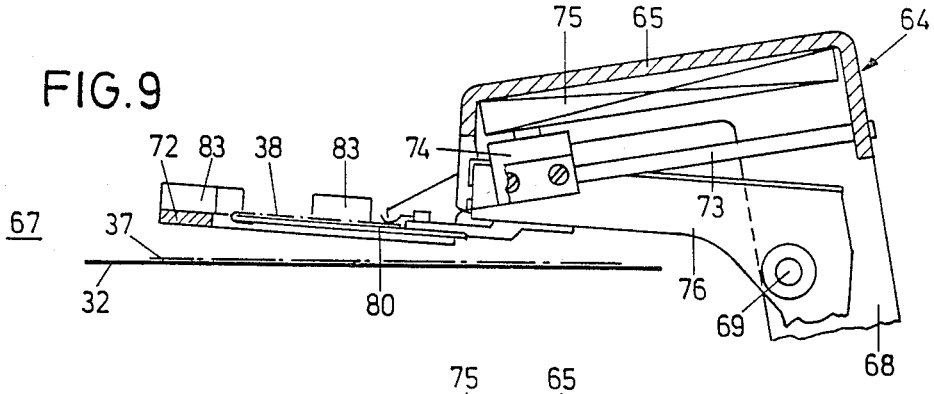
FIG. 9 shows the folding device according to FIG. 8, in another working position.

When in the starting position the outer frame carrier 65 is pivoted upwardly, i.e. the tilt drive 71 is fully retracted. The outer frame 72 is retracted into the carrier 65. The sword 80 can, but does not have to be moved into its retracted position. The first workpiece 37 is laid on the carrier plate 32, which can be observed quite freely and without hindrance, and adjusted thereon. If the sword 80 was in its retracted position, it is moved out by actuating the sword displacing drive 82 and the second workpiece 38 is laid on the sword 80 which in all cases is in its upwardly pivoted position above the first workpiece 37. The second workpiece 38 is retained on the sword with a clamping action by clamping holders 84. Then the sword 80 is lowered into its lower position by appropriate actuation of the sword tilt drive 78, as a result of which it comes to rest on the first workpiece 37. Now the first workpiece 37 is aligned relative to the second workpiece 38. Now, as a result of corresponding reverse actuation of the sword tilt drive 78 the sword 80 is pivoted upwardly again into its upper position, i.e. lifted by the first workpiece 37. At the same time the outer frame 72 is moved by appropriate actuation of the outer frame displacing drive 75, out of the carrier 65 which is still in its upwardly pivoted position. Then the carrier 65 is lowered with the outer frame 72 into its intermediate position on the sword 80 by appropriate actuation of the outer frame tilt drive 71, as shown in FIG. 9. Then the creasing modules 83 are actuated, whereby the second workpiece 38 is folded around the sword 80. Then the two tilt drives 71 and 78 are actuated so that the outer frame carrier 75 and the sword carrier 76 are lowered jointly down on to the carrier plate 32 with the first workpiece 37. Then the creasing modules 83 are released and the outer frame 72 is pivoted upwardly by the angle s by appropriate actuation of the outer frame tilt drive 71. At the same time the outer frame displacing drive 75 is actuated whereby the outer frame 72 is moved in the direction of the rear side 66 into the carrier 65. The sword 80 is still situated with the second workpiece 38 on the first workpiece 37 and holds the latter firmly at this point. This working position is shown in FIG. 10. Now one of the workpiece holders 52 or 53 is moved over the two workpieces 37, 38 and lowered on to them in the manner already described. Then by appropriate actuation of the displacing drive 82 the sword 80 is drawn out of the position between the two workpieces 37, 38 in the direction of the rear side 66. After the sword is drawn out, the sword tilt drive 78 is actuated with the effect that the sword carrier 76 enters its upwardly pivoted position. The folding device is then again in the starting position shown in FIG. 7. The various drives 71, 75, 78, 82 are normally triggered by the operator by means of a foot or hand switch with is not shown. There is a connection with the previously described drives of the feeding devices 39, 40, which are controlled by the computerized control 12, in that a workpiece holder 52, 53 can only be moved over the workpieces 37, 38, which are situated or manipulated in the transfer position 58, if the outer frame 72 is moved upwardly and back. Each workpiece holder 52 or 53 can only be moved out of the transfer position 58 into the sewing position 59 if the sword 80 is drawn out. It follows from the preceding description of the mode of operation that during the entire working time during which the workpieces 37, 38 are aligned, the outer frame 72 is in its retracted position in the carrier 65 so that the operator can handle the workpieces 37, 38 freely and in particular with good visibility. It can be seen particularly in FIG. 1 that the entire working area in the region of the transfer position 58 is freely accessible with the outer frame 72 retracted and that also the workpiece holders 52, 53, cannot collide with the outer frame 72 because the latter can be drawn back to such an extent that the corresponding section of the angle lever 55' of the workpiece holder 53 does not come into contact with the outer frame 72.

Slidability of the Folding Device

In order that the folding device 64, which in this case is therefore in very general terms a device for preparing the workpieces 37, 38, may be brought into an optimum position, i.e. the closest possible position to the sewing position 59, it is slidable on the tilt axle 69 in the x-direction. In addition, it can naturally be fixed relative to the stand 1. In the case of large workpieces and correspondingly large workpiece holders 52 or 53, the distance between the transfer position 58 and accordingly the distance between the waiting position 61 and the sewing position 59 must have a specific measure, the maximum distance Lmax being predetermined by the largest workpieces that can be handled on the machine. When in this position on the folding device 64 is approximately in contact with the bearing arm 70 remote from the sewing head 2, as shown in FIG. 1. The minimum possible distance between the folding device 64 and the needle 31 of the sewing head 2 exists if the folding device 64 bears approximately against the bearing arm 70 adjacent to the sewing head 2. This position is not shown in the drawing.

Figure 6:
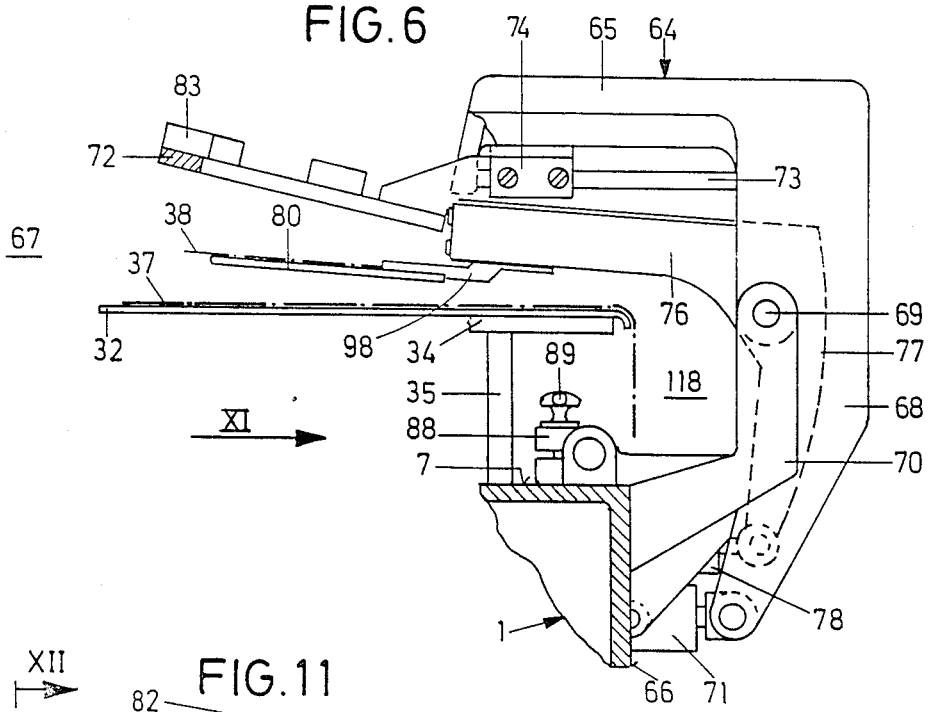
FIG. 6 shows a vertical partial section through the automatic sewing machine corresponding to the line VI—VI in FIG. 2 which shows a folding device in a side view.
Figure 11:
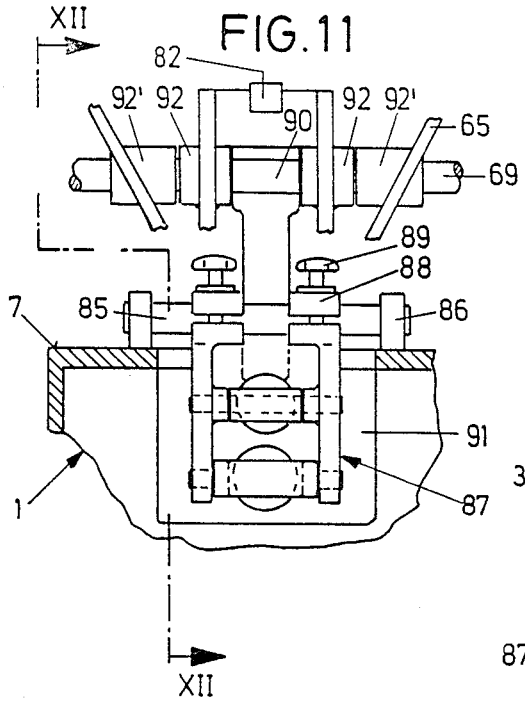
FIG. 11 shows a partial view of the folding device, as shown in the direction of arrow XI in FIG. 6.
Figure 12:
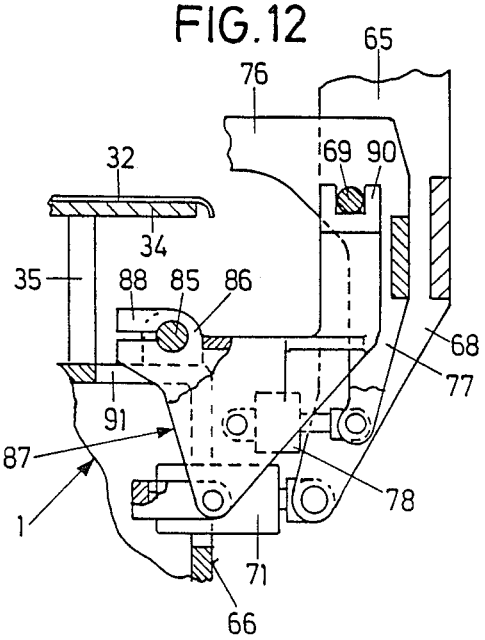
FIG. 12 shows a partial view of the folding device along the line XII—XII in FIG. 11.
Figure 7:
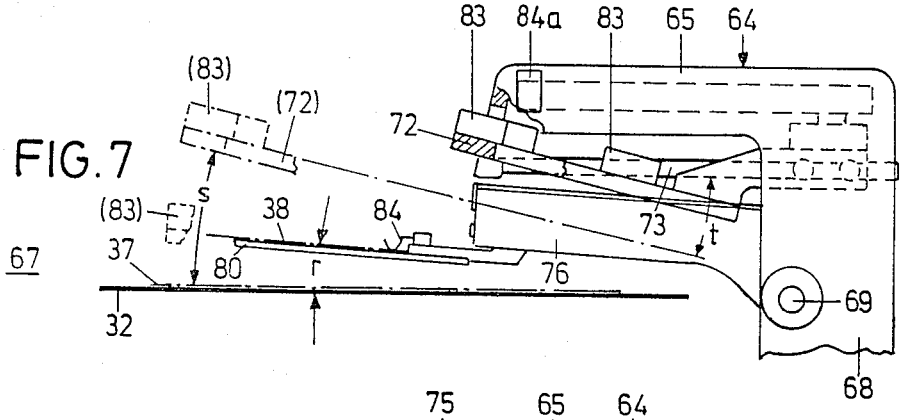
FIG. 7 shows a partial view of the folding device, in a work starting position.

The details of this design are evident from FIGS. 6, 11 and 12. A bar 85 is rigidly mounted in bearings 86 on the upper side 7 of the stand 1. A drive carrier 87 is mounted on this bar 85 and retained by means of a clamping device 88 acting as an axial locking means, it being possible for the clamping to be either created or released by means of clamping screws 89. This drive carrier 87 is also guided on the tilt axle 69 by means of a jaw bearing 90 so that the drive carrier 87 is not pivotable perpendicular to the bar 85 or tilt axle 69, but can only be displaced on the bar 85 and the tilt axle 69 in the longitudinal direction thereof. The outer frame tilt drive 71 and the sword tilt drive 78 are articulated on the drive carrier 87. The drive carrier projects into a recess 91 in the upper side 7 and rear side 66 of the stand 1. As is shown particularly in FIG. 11, the jaw bearing 90 of the drive carrier 87 engages between two tubular bearings 92 of the sword carrier 76 wich are situated on the tilt axle 69. The corresponding tubular bearings 92' of the outer frame carrier 65 in turn bear against these tubular bearings 92. Therefore, in each case the entire folding device 64, i.e. its outer frame carrier 65, the sword carrier 76 thereof and the drive carrier 87 thereof, is moved together on the bar 85 and the tilt axle 69. Only the bar 85 and the tilt axle 69 are fixed to the stand. Obviously the free displacement path on the bar 85 corresponds to the above mentioned free displacement distance of the tilt axle 69. As shown in FIG. 1, the first workpiece 37 is usually an elongated workpiece, for example a trouser piece, which is arranged on the carrier plate 32 in such a manner that its principal longitudinal extension is in the y-direction, i.e. perpendicular to the x-direction corresponding to the feeding direction. Because the second workpiece 38 in this case is a pocket piece, the seam 60 necessary for sewing these two workpieces 37, 38 together has an approximately U-shaped course. It follows that the slot 57 formed in each workpiece holder 52 or 53 comprises two longitudinal slots **57*a*, 57*b*, which are parallel to one another and perpendicular to the x-direction, and a transverse slot 57*c* which connects these two longitudinal slots 57*a*, 57*b* at one end. The longitudinal slots 57*a* and 57*b* run in the direction of the principal extension of the first workpiece 37. It follows that the two workpieces 37, 38 are transferred from the transfer position 58 into the sewing position 59 at right angles to the principal longitudinal direction of the first workpiece and at right angles to the direction of the longitudinal slots 57*a* and 57*b*. On the folding device 64, that is preferably on the outer frame carrier 65, it is possible to mount a sensor 84*a* which transmits a signal to the computerized control 12 if a workpiece holder 52 or 53 moves into the transfer position 58. By doing this, precise positioning of respective workpiece holders 52 and 53 to the folding device 64 occurs in their respective positions relative to the sewing head 2. With the described arrangement of the sensor 84*a* a continuous automatic detection of the position of the folding device 64 relative to the sewing head 2 is achieved economically, i.e the distance covered by the workpiece holders 52, 53 is adapted to each respective position of the folding device 64 in an automatic and operationally reliable manner. In the case of a simpler design micro stop switches 84*b* and 84*c* are mounted at two end points of the displacement path, i.e. for example on the bearing arms 17, and these switches transmit an appropriate signal to the computerized control 12 when the folding device 64 is in one of the two possible end positions. This computerized control then adapts the corresponding displacement paths of the feeding devices 39, 40 to this corresponding position of the folding device 64**.

Design of a Vacuum Fixing Device for the Workpieces

Figure 14:
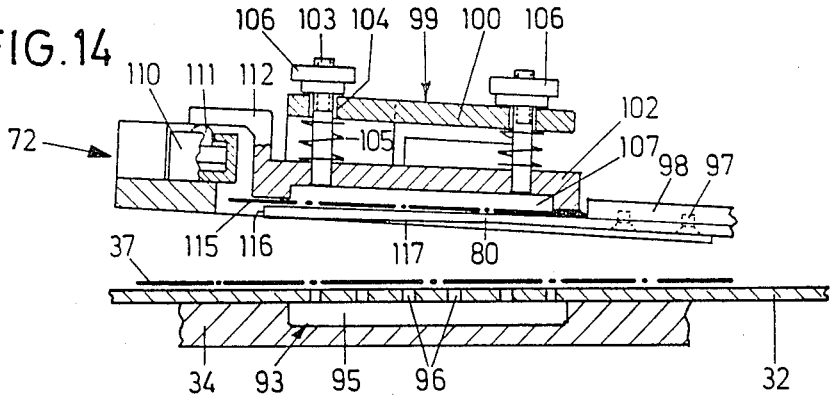
FIG. 14 shows a vertical longitudinal section through the outer frame, the sword and the associated area of the carrier plate along the line XIV—XIV in FIG. 13, before the folding of a workpiece.
Figure 15:
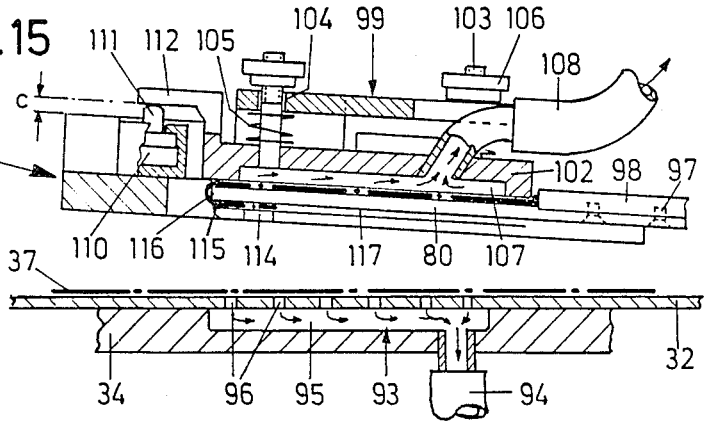
FIG. 15 shows a vertical longitudinal section through the outer frame, the sword and the associated area of the carrier plate along the line XV—XV in FIG. 13, after the folding of the workpiece.

In order that the first workpiece 37 may also maintain an aligned position when aligned on the carrier plate 32, there is provided in the area of the transfer position 58 where this workpiece is aligned, a vacuum fixing device 93 as can be seen in FIGS. 14 and 15. In this connection there is provided in the supporting plate 34 a recess 95 which is connected to a vacuum line 94. This recess is associated with vacuum openings 96 formed in the carrier plate 32 so that, when the recess 95 is subjected to a vacuum accordingly, the first workpiece 37 is retained on the carrier plate 32 in a manually aligned position.

As shown in FIGS. 6 to 10 and 14, 15, the sword 80 is very thin in design, and is made for example of a thin, very flexible sheet, therefore particularly of spring steel. In order that the user of the automatic sewing machine may manufacture himself and replace such a sword 80 according to his requirements, it is attached interchangeably by means of screws 97 to a sword holder 98 connected to the slide bearing 81. The sword 80 itself shall be very thin in order that the second workpiece 38 which is folded around the edges of the sword does not have any excess width.

If, on the other hand, the sword 80 is made of thin sheet, it bends downwardly when the outer frame 72 is put on it. In order to prevent this, a vacuum holding device 99 for the sword 80 is provided in the outer frame 72, as shown in FIGS. 13 to 15.

A carrier plate 100 is secured on the upper side of the outer frame 72 by means of screws 101. A suction plate 102 is suspended from this carrier plate. For this purpose the suction plate 102 has a plurality of, and preferably three upwardly projecting threaded bolts 103 which project through corresponding bores 104 in the carrier plate 100. Preloaded compression springs 105 are arranged on the threaded bolts between the suction plate 102 and the carrier plate 100. Knurled nuts 106 serving as adjusting elements are screwed down on the threaded bolts 103. The maximum distance between the suction plate 102 and carrier plate 100 is set by means of these knurled nuts 106. Adjustment of the suction plate 102 relative to the sword 80 can therefore take place. In the lower side of the suction plate 102 there is formed a suction chamber 107 which is open towards the sword 80, i.e. downward and which is connected to a suction line 108.

Arranged in the central longitudinal axis 109 of the outer frame 72 and thus of the sword 80 is a lifting drive 110 which comprises a small pneumatically actuatable piston-cylinder drive. An overhanging arm 112 of the suction plate 102 rests on the free end of the piston rod 111 of this lifting drive 110. As a result of pneumatic actuation of the lifting drive 110 and consequent extension of the piston rod 111, the suction plate 102 can thus be pivoted upwardly by a short distance c in opposition to the force of the compression springs 105.

Figure 13:
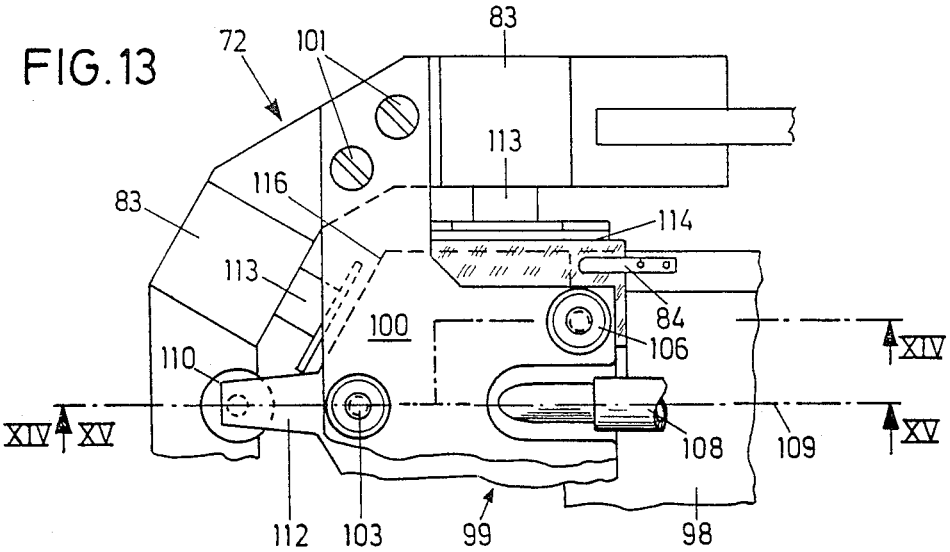
FIG. 13 shows a partial plan view of a specially designed embodiment of the outer frame of the folding device.

It can be seen from FIG. 13 that the creasing modules 83—as already mentioned above—have a pneumatically actuatable creasing drive, to the piston rod 113 of which a creasing blade 114 is attached, which creasing blade folds the associated edge 115 of the second workpiece 38 around the associated edge 116 of the sword 80 by pressing this edge 115 around the edge 116 against the underside 117 of the sword 80.

Mode of Operation of the Vacuum Fixing Device

When the first workpiece 37 is placed on the carrier plate 32 and when the sword 80 is pivoted upwardly again into the intermediate position with the second workpiece 38 which is aligned on the sword relative to the first workpiece 37, and when the outer frame 72 is also lowered into this intermediate position, as shown in FIG. 9, the suction chamber 107 is then subjected to a partial vacuum via the suction line 108, as a result of which the sword 80, with the workpiece 38 resting thereon, is drawn against the suction plate 102 and secured there. The lowering of the outer frame 72 or suction plate 102 on to the sword 80 causes deformation of the thin sword 80, as shown in FIG. 14. Then the lifting drive 110 is actuated whereby the suction plate 102 together with the sword 80 and workpiece 38 is pivoted upwardly by the distance c into the position shown in FIG. 15 so that the deformation mentioned is cancelled and the creasing operation can be subsequently initiated. For this purpose the creasing modules 83 are pneumatically actuated whereby the creasing blades 114 push the edge 115 of the workpiece 38, in the manner mentioned, around the edge 116 of the sword 80 against the underside thereof.

Following this, the outer frame 72 is lowered together with the sword 80, in the manner already described above, into the position shown in FIG. 10 on to the first workpiece 37, the load on the lifting drive 110 being relieved at the same time so that the suction plate 102 and the sword 80 are forced downward by the compression springs 105. By appropriate actuation of the creasing modules 83 the piston rods 113 thereof are extended with the creasing blades 114 under the folded edge 115. The margin 115 is now pressed firmly on to the lower first workpiece 37 by the compression springs 105 via the sword 80. Then the partial vacuum is cancelled in the suction chamber 107. The outer frame 72 is subsequently lifted and moved back in the manner already described.

After one of the two workpiece holder 52 or 53 is lowered on to the two workpieces 37, 38, the partial vacuum is cancelled by appropriate ventilation of the recess 95 which serves as a vacuum chamber. This is followed by the removal of the sword 80 from the folded second workpiece 38. Then the bundle consisting of the workpieces 37, 38 can be displaced.

Figure 16:
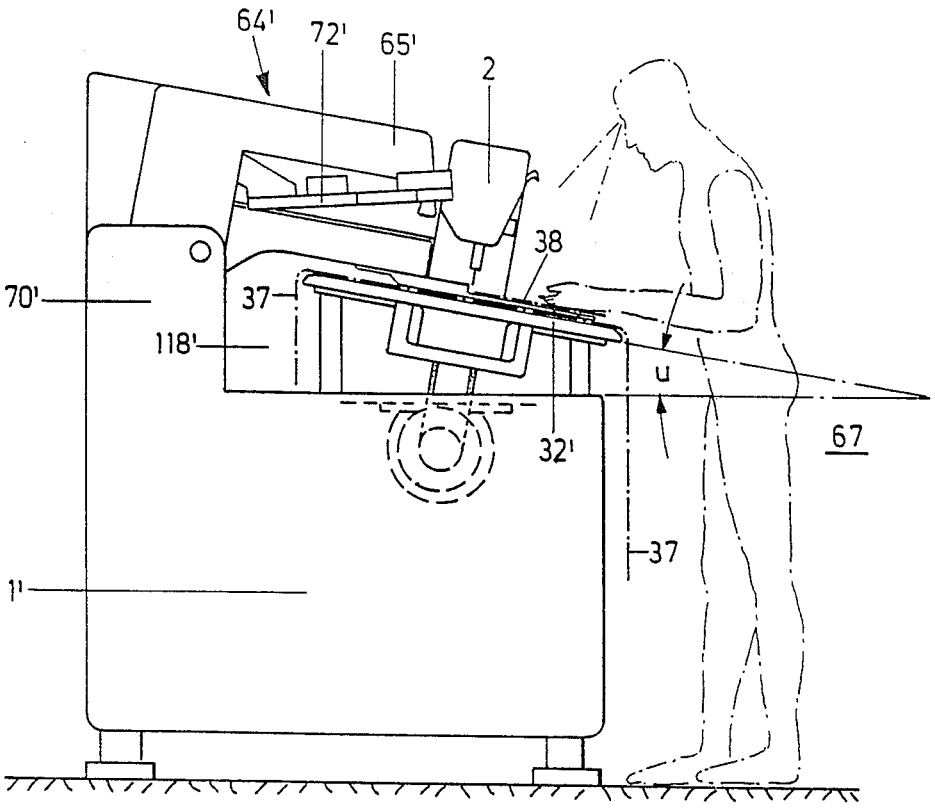
FIG. 16 shows, in side view, an automatic sewing machine with all the important units in an inclined arrangement relative to the operator.

It can be seen from FIG. 16 that all the essential components can be inclined to such a degree that the operator stands in front of the automatic sewing machine in an ergonomically favorable position. All the essential components, which are slightly modified by being inclined, are provided with the same reference numerals as in the above description, with a prime mark being added to each of the reference numerals. The carrier plate 32' is inclined by an angle u of 10° to 15° relative to the horizontal. The folding device 64' is inclined accordingly. In this case also the angle s described above is therefore measured relative to the additionally inclined carrier plate 32'. In FIG. 16—just as in FIG. 6—it can be seen that between the carrier plate 32 or 32', on one side, and the bearing arm 70 or 70' of the stand 1 or 1' there is a free space 118 or 118' in which the first lower workpiece 37 can be suspended if it projects above the carrier plate 32 or 32' in this area. Large workpieces can therefore be fabricated. In addition, this development makes it possible to use an automatic feeding device which, with corresponding arms, moves into the free space 118 or 118', on the one hand, and on the operator's side, on the other. In order that such large workpieces 37 may also be moved under the sewing head 2, the feeding devices 39, 40 are arranged at intervals above the carrier plate 32—as can be seen from FIGS. 2 and 3. As is also evident from FIGS. 1 and 6 in this connection, the edge of the carrier plate 32 that is remote from the operator's side 67 extends in a straight line in the x-direction out of the free space 118. Large first workpieces 37 which therefore project into the free space 118 also therefore hang down during subsequent conveyance over this edge. The stand 1 is therefore designed in the form of an inverted U, i.e. on the side remote from the operator's side 67 it is not wider than necessary for receiving the second feeding device 40.

What is claimed is:

1. Folding device for an automatic sewing machine, comprising a carrier plate (32) for a first workpiece (37);

a sword (80) attached to a sword carrier (76) for receiving a second workpiece (38);

an outer frame (72) attached to an outer frame carrier (65) and having creasing devices (83) for folding the second workpiece (38) around the sword (80);

a first working position of sword (80) on the carrier plate (32) and a second working position of the sword (80) in a vertical distance with respect to the carrier plate (32); means for causing relative motion between the carrier plate (32) and the sword (80) between said first working position and said second working position;

a first working position of the outer frame (72) on the carrier plate (32), a second working position of the outer frame (72) which is substantially identical with the second working position of the sword (80) and above this second working position an upper work starting position of the outer frame (72); means for causing relative motion between the carrier plate (32) and the outer frame carrier (65) between the said working and work starting positions of the outer frame (72); and means for drawing out the sword (80) of one of its working positions into a retracted position out of the second workpiece (38); wherein means are provided for moving the outer frame (72) out of its working and work starting positions into a retracted position in the outer frame carrier (65).

2. Folding device according to claim 1, wherein the outer frame carrier (65) has a slidable carriage (74) which bears the outer frame (72).

3. Folding device according to claim 2, wherein the carriage (74) is slidable on guides (73) in the outer frame carrier (65).

4. Folding device according to claim 3, wherein an outer frame displacing drive (75) is provided in the outer frame carrier (65).

5. Folding device according to claim 1, wherein the 20 outer frame carrier (65) and the sword carrier (76) are mounted pivotally about a common tilt axle (69).

6. Folding device according to claim 3, wherein the guides (73) of the outer frame (72) are inclined relative to the outer frame (72) in such a manner that, when the sword (80) and outer frame (72) are in the working position on the carrier plate (32), the sword carrier (76) and the outer frame carrier (65) have a smaller spacing on a side remote from the tilt axle (69) and a side facing the outer frame (72) or the sword (80) than on a side facing the tilt axle (69).

7. Folding device according to claim 6, wherein the sword carrier (76) engages between the guides (73) of the outer frame carrier (65), when the sword (80) and the outer frame (72) are in the working position on the carrier plate (32).

8. Folding device according to claim 6, wherein an angle of inclination (t) between the outer frame (72) and the guides (73) is approximately 10 to 25 degrees.

9. Folding device according to claim 8, wherein the angle of inclination (t) is approximately 19 degrees.

10. Folding device according to claim 5, wherein a free space (118) which is open in a direction parallel to the tilt axle (69) and extends as far as below the carrier plate (32) is formed between the carrier plate (32) and the tilt axle (69).

* * * * *